US005536903A

United States Patent [19]

Kitayama et al.

[11] Patent Number: 5,536,903

[45] Date of Patent: Jul. 16, 1996

[54] MUSICAL TONE SYNTHESIZING APPARATUS HAVING A LOOP CIRCUIT

[75] Inventors: Toru Kitayama; Akira Yamauchi, both of Hamamatsu, Japan

[73] Assignee: Yamaha Corporation, Japan

[21] Appl. No.: 212,278

[22] Filed: Mar. 14, 1994

[30] Foreign Application Priority Data

Mar. 16, 1993 [JP] Japan ..... 5-056085

[51] Int. Cl.[6] ..... G10H 1/08; G10H 5/00

[52] U.S. Cl. ..... 84/660; 84/661; 84/665; 84/625

[58] Field of Search ..... 84/622, 630, 659, 84/660, 661, 625, 633, 665

[56] References Cited

U.S. PATENT DOCUMENTS

| | | | |
|---|---|---|---|
| 4,649,783 | 3/1987 | Strong et al. . | |
| 4,736,333 | 4/1988 | Mead et al. . | |
| 5,231,240 | 7/1993 | Lu | 84/660 |
| 5,241,604 | 8/1993 | Noguchi | 84/630 X |
| 5,246,487 | 9/1993 | Oguri | 84/630 X |
| 5,278,350 | 1/1994 | Okamoto et al. | 84/661 X |
| 5,286,914 | 2/1994 | Kunimoto | 84/622 X |
| 5,359,146 | 10/1994 | Funaki et al. | 84/661 X |
| 5,382,751 | 1/1995 | Kitayama et al. | 84/661 |

*Primary Examiner*—William M. Shoop, Jr.

*Assistant Examiner*—Jeffrey W. Donels

*Attorney, Agent, or Firm*—Graham & James

[57] ABSTRACT

A musical tone synthesizing apparatus at least comprises two loop circuits. Each loop circuit delays an input signal thereof by a delay time corresponding to a tone-pitch period of a musical tone to be produced while circulating the input signal therethrough. When the loop circuits are connected in series, an excitation signal is applied to one loop circuit, while an output signal of one loop circuit is supplied to another loop circuit. Then, the excitation signal is mixed together with the output signals of the loop circuits, so that a musical tone signal representing a synthesized musical tone is generated. The excitation signal is generated by mixing a noise signal and a musical-tone-waveform signal. When simulating the violin sounds, the noise signal is made based on a frictional sound which is caused due to a friction between a string and a bow. Incidentally, a filter can be provided to perform a filtering operation on each of the excitation signal and the output signals of the loop circuits. Further, an overflow detecting circuit can be provided to detect an overflow event in which a signal level of the signal circulating through each loop circuit exceeds a predetermined limit value representing the maximum value of the digital data, used in the apparatus, whose number of bits is determined in advance. When the overflow event is detected, an input level of each loop circuit is automatically adjusted. incidentally, the signal level can be visually indicated by indicators such as LEDs.

17 Claims, 11 Drawing Sheets

MUSICAL TONE SYNTHESIZING APPARATUS HAVING A LOOP CIRCUIT

BACKGROUND OF THE INVENTION

1. Field of the Invention

The present invention relates to a musical tone synthesizing apparatus which synthesizes musical tones by effecting delay processes on excitation signals applied thereto.

2. Prior Art

FIG. 12 is a block diagram showing a simplified configuration of an example of the musical tone synthesizing apparatus conventionally known. In FIG. 12, a numeral 1 denotes an excitation-signal generating circuit which generates and continuously outputs excitation signals, wherein each of those excitation signals contains a plenty of noise components but does not contain a component for a tone-pitch parameter (hereinafter, simply referred to as a tone-pitch component). Numerals 2 and 3 denote loop circuits, both of which have the same configuration at least containing a delay circuit and a filter. A loop delay which is occurred when the signal circulates through each of the loop circuits 2 and 3 at one time is set identical to a tone-pitch period of the musical tone to be produced. A comb-like frequency characteristic is employed by each of the loop circuits 2 and 3. Herein, the lowest frequency, which corresponds to one of the peaks of the comb-like frequency characteristic but which is not equal to 0 Hz, coincides with the tone-pitch frequency of the musical tone to be produced, while each of the frequencies, which correspond to the other peaks of the comb-like frequency characteristic, is roughly equal to a multiple of the tone-pitch frequency of the musical tone to be produced. Hence, by supplying the signal to the loop circuits 2 and 3, the tone-pitch component will be incorporated into the signal.

Next, the description will be given with respect to the reason why the loop circuits 2 and 3 are connected in series as shown in FIG. 12. When using one of the loop circuits 2 and 3 only in the musical tone synthesizing apparatus, in order to increase an amount of tone-pitch components, the comb-like frequency characteristic which is applied to the signal circulating through the loop circuit should be modified such that the peaks of the comb-like frequency characteristic are made sharper. In order to do so, it Is necessary to increase the loop gain of the loop circuit.

However, If the loop gain of the loop circuit is increased excessively, a transient-response period should become longer, which raises a problem that the musical tone cannot be attenuated soon and the stability in the operation of the loop circuit may be somewhat damaged. In the worst case, an operational error should be happened. For this reason, the comb-like frequency characteristic employed in the loop circuit is set such that the peaks are not made sharper so much. However, this causes another problem that the tone-pitch component cannot be made clear.

Thus, the two loop circuits 2 and 3 are connected in series in the circuit shown in FIG. 12. This circuit can offer a sharper peak for the comb-like frequency characteristic, embodied by the loop circuits 2 and 3 as a whole without making the transient-response period longer so much. By continuously applying the excitation signal, which does not contain the tone-pitch component, to those loop circuits 2 and 3, it is possible to synthesize a sustain-type musical tone having a high quality in its sustain portion.

Meanwhile, some of the musical tone synthesizing apparatuses conventionally known are designed to use a single loop circuit which can offer a sufficient amount of tone-pitch components. Another example of the musical tone synthesizing apparatus is designed as shown in FIG. 13, wherein the loop circuits 2 and 3 are connected in parallel and their outputs are added together by an adder 4. Particularly, when synthesizing a decay-type musical tone, the loop gain of each loop circuit should be increased, while the excitation-signal generating circuit 1 should generate the excitation signal instantaneously. Such excitation signal instantaneously generated is supplied to the above-mentioned single loop circuit or the loop circuits connected in parallel. Thus, by using the transient-response period of each loop circuit which is relatively long, the decay-type musical tone can be synthesized.

In the circuit shown in FIG. 12, an output signal of the loop circuit 3 represents the synthesized musical tone containing the tone-pitch component. In the circuit shown in FIG. 13, an output signal of the adder 4, which adds the outputs of the loop circuits 2 and 3 together, represents the synthesized musical tone containing the tone-pitch component.

In the musical tone synthesizing apparatuses conventionally known, it is possible to synthesize the musical tones containing the tone-pitch components as described above. However, in the synthesized musical tone, overtone components should be artificially incorporated and they are disposed orderly in the frequency characteristic of the synthesized musical tone. In other words, there is a drawback that as compared to acoustic musical tones, which are produced from acoustic musical instruments, the synthesized musical tones are unsatisfactory for the listeners.

Now, by taking an example of the violin, the complexity of the acoustic musical tone produced by the acoustic musical instrument will be described in detail. In the violin, by bowing a string (or strings), the musical tone is produced. In this case, energy, which is produced when the performer operates the bow, is transmitted to the string so that vibration is occurred and is transmitted through the string between its both-side terminals In a manner of reciprocating motion. That vibration causes waves of the string, so that the body of violin resonates to those waves. Hence, the waves are acoustically amplified, so that corresponding sound waves are radiated into the air.

In general, the violin does not merely produce the sounds corresponding to the waves of vibration which are transmitted between the both-side terminals of the string in a reciprocating manner. Other than those sounds, the violin can produce frictional sounds as well, which are produced due to the friction between the bow and string. Those frictional sounds are radiated into the air from a point at which the bow comes in touch with the string or from the bow. Those sounds do not occupy the main part of the violin sounds, however, a part of them is certainly transmitted to the ears of the listener. Those frictional sounds contributes to a unique acoustic effect of the violin sounds. In other words, the real acoustic characteristic which is obtained when a part of the frictional sounds is radiated into the air is different from the acoustic characteristic which is obtained when the waves, which are produced when the body of violin resonates to the waves transmitted through the string only, are acoustically amplified and are radiated into the air.

As described above, the acoustic sound produced from the acoustic musical instrument contains the tone-pitch component and the complexity, so that the acoustic sound can offer a unique acoustic effect to the listener as compared to the musical tone artificially synthesized.

In the musical tone synthesizing apparatuses described before, the loop circuits 2 and 3 are designed to simulate the reciprocating transmission of the waves which are transmitted between the both-side terminals of the string of the violin. The output signal of the loop circuit 3 in the circuit shown in FIG. 12 or the output signal of the adder 4 in the circuit shown in FIG. 13 is amplified by the amplifier (not shown); and then, the output signal is converted into the sound by a so-called electric sound converter such as the speaker (not shown). The above amplification and electric conversion may correspond to the aforementioned phenomenon in which the body of violin resonates to the waves reciprocating between the both-side terminals of the string so that those waves are acoustically amplified; and then, the corresponding sound waves are radiated into the air.

In the acoustic musical instrument such as the violin, the musical tone acoustically produced contains the noise component such as the frictional sound, which is produced due to the friction between the bow and string, as well as the main component corresponding to the sound produced from the waves of vibration on the string. However, the musical tone synthesizing apparatuses conventionally known are not designed to synthesize the noise-component sounds other than the main-component sounds. In short, the musical tones artificially synthesized are unsatisfactory for the listener as compared to the acoustic sounds.

In the musical tone synthesizing apparatus, each of circuit elements is normally embodied by the digital circuit. In the circuit shown In FIG. 13, several kinds of parameters such as the tone-color parameter are used for each of the loop circuits, whereas the output signals of the loop circuits are added together by the adder. However, every time the parameter used for the loop circuit is changed, the level of the output signal of the loop circuit should be changed.

In some cases, the value of the output signal of the adder or the output value of each circuit element may exceed a limit value which corresponds to the predetermined number of bits employed by the musical tone synthesizing apparatus. In short, an overflow event is occurred. If such overflow event is occurred, the musical-tone waveform corresponding to the output signal of the adder should be somewhat distorted so that the desired musical tone cannot be obtained. Such drawback can be overcome by increasing the number of bits used for each of the circuit elements such as the adder to the satisfactory number. However, this results In an increase of the size of the circuit element, which will lead to a raise of the cost required for manufacturing the musical tone synthesizing apparatus.

SUMMARY OF THE INVENTION

It is accordingly a primary object of the present invention to provide a musical tone synthesizing apparatus which is capable of synthesizing the musical tones well simulating the complexity of the acoustic sounds.

It is another object of the present invention to provide a musical tone synthesizing apparatus which is capable of synthesizing the musical tones with a high quality even when the musical-tone parameter is changed.

According to a fundamental configuration of the present invention, a musical tone synthesizing apparatus comprises two loop circuits and one mixer. Each loop circuit delays an input signal thereof by a delay time corresponding to a tone-pitch period of a musical tone to be produced while circulating the input signal therethrough. The excitation signal is supplied to at least one of the loop circuits as its input signal. The mixer mixes the excitation signal together with the output signals of the loop circuits, so that a musical tone signal representing a synthesized musical tone is generated. The excitation signal is generated by mixing a noise signal and a musical-tone-waveform signal. Further, a filter can be provided to perform a filtering operation on each of the excitation signal and the output signals of the loop circuits. Furthermore, an overflow detecting circuit can be provided to detect an overflow event in which a signal level of the signal circulating through each loop circuit exceeds a predetermined limit value representing the maximum value of the digital data, used in the apparatus, whose number of bits is determined in advance. When the overflow event is detected, an input level of each loop circuit is automatically adjusted. Incidentally, the signal level can be visually indicated by indicators such as LEDs.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings.

DESCRIPTION OF THE PREFERRED EMBODIMENTS

[A]First embodiment

Figure 1:
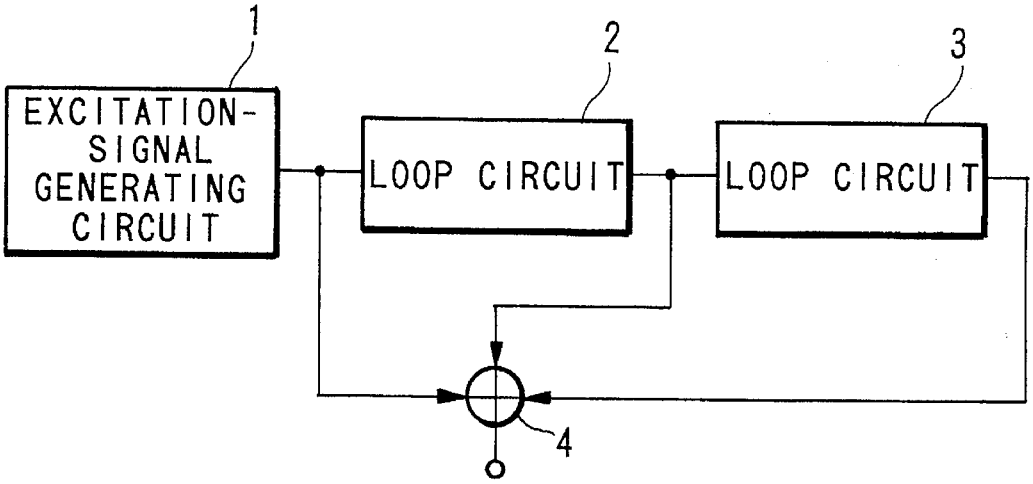
FIG. 1 is a block diagram showing a musical tone synthesizing apparatus according to a first embodiment of the present invention.
Figure 13:
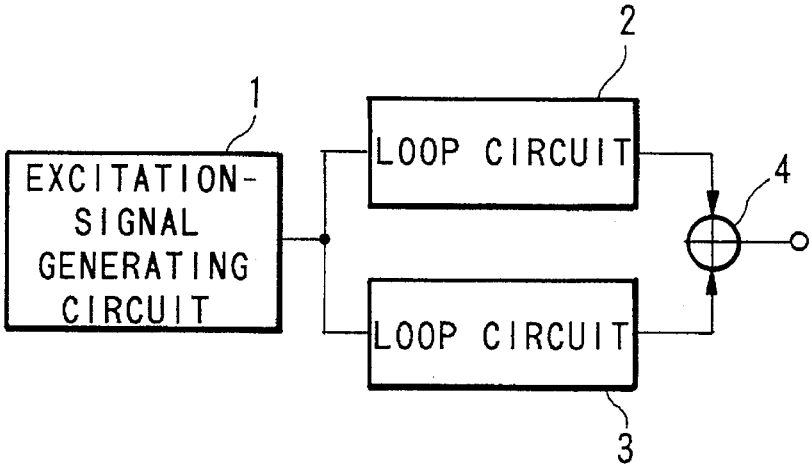
FIG.13 (PRIOR ART)
FIG. 13 is a block diagram showing another example of the conventional musical tone synthesizing apparatus.

FIG. 1 is a block diagram showing a musical tone synthesizing apparatus according to a first embodiment of the present invention. In FIG. 1, parts identical to those shown in FIG. 13 are designated by the same numerals; hence, the description thereof Will be omitted. In FIG. 1, the adder 4 adds the output signals, respectively outputted from the loop circuits 2 and 3, so as to mix them together by a predetermined ratio.

The output signal of the loop circuit 2 is relatively poor in the richness of the musical tone as compared to the excitation signal. However, as compared to the excitation signal, an amount of noise components contained in the output signal of the loop circuit 2 is reduced. So, as compared to a configuration in which the adder adds the excitation signal and the output signal of the loop circuit 3 only, the adder 4 in the first embodiment further adds the output signal of the loop circuit 2, by which it may be possible to improve the richness of the musical tone to be synthesized. In other words, the first embodiment can offer the synthesis for the musical tones which are richer and are close to the acoustic sounds. Incidentally, the ratio by which the excitation signal and the output signals of the loop circuits 2 and 3 are mixed together can be determined or adjusted through trial and error such that the desired musical tones can be synthesized.

In the first embodiment, if the mixing ratio by which the excitation signal is Incorporated into the output of the adder 4 is increased, the musical tones to be synthesized are improved in the richness as compared to the conventional musical tone synthesizing apparatus. However, due to the existence of the noise components which are originally included in the excitation signal, the musical tones which are produced in accordance with the outputs of the adder 4 are heard as if the true musical-tone components are separated from the noise components. In short, when the mixing ratio of the excitation signal is increased, the musical tones synthesized by the first embodiment may be similar to the musical tones which are synthesized by the musical tone synthesizing apparatus whose S/N ratio is not so good.

In contrast, when the mixing ratio of the excitation signal is reduced, the S/N ratio sensed by the listener can be improved. In this case, however, the musical tones synthesized by the first embodiment are not superior to the musical tones synthesized by the conventional musical tone synthesizing apparatus in the richness.

In short, the musical tone synthesizing apparatus according to the first embodiment is effective only when the excitation-signal generating circuit 1 generates the excitation signal whose property is adjusted such that even if the mixing ratio of the excitation signal is increased, the noises do not damage the quality of the musical tones to be heard by the listener. In other words, the first embodiment has a relatively narrow application in the synthesis of the musical tones.

[B]Second embodiment

Next, the description will be given with respect to a second embodiment of the present Invention which can offer the richness of the musical tones as well as the good S/N ratio of the musical tones.

Different from the musical tones synthesized by the first embodiment, the acoustic sounds, which are actually produced from the acoustic musical instruments such as the violin, have the richness as well as the good S/N ratio.

The reason why the acoustic musical instrument can produce such high-quality sounds will be described below. When the bow and string are rubbed together. The frictional sounds are produced as described before. The aforementioned reciprocating transmission of the waves between the terminals of the string is originated from the rubbing action between the bow and string. In addition, a part of those frictional sounds is radiated into the air from the bow or from a rubbing point between the bow and string so that the frictional sounds are partially transmitted to the ears of the listener.

The real acoustic characteristic (i.e., frequency characteristic of the violin sounds) in which the frictional sounds are partially radiated into the air as well is different from the acoustic characteristic in which when the body of violin resonates to the waves repeatedly transmitted on the string between its terminals, the sound waves are acoustically amplified and are radiated into the air. In general, as compared to the latter acoustic characteristic, the former acoustic characteristic may be strongly affected by specific factors, the characteristics of which can be interpreted into the characteristics of the electric circuits such as the low-pass filter and band-pass filter.

Figure 2:
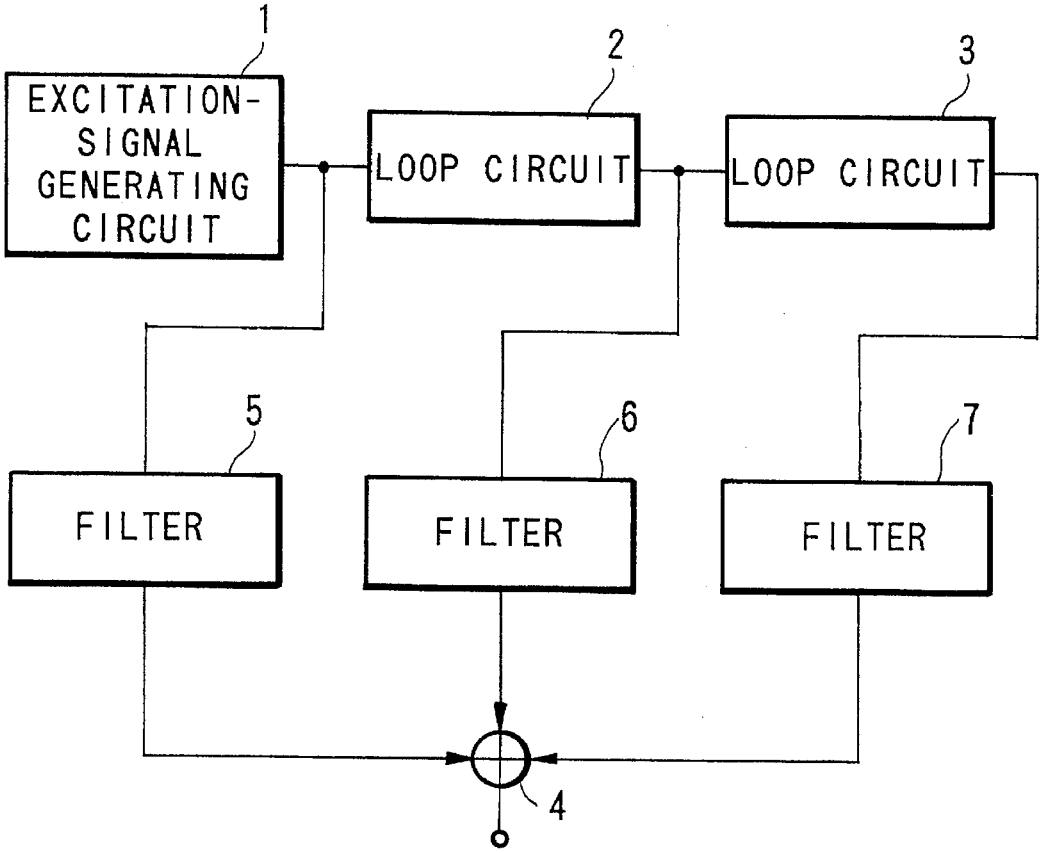
FIG. 2 is a block diagram showing a musical tone synthesizing apparatus according to a second embodiment of the present invention.

Thus, the second embodiment is designed as shown in FIG. 2 such that an output terminal of the excitation-signal generating circuit 1 and output terminals of the loop circuits 2 and 3 are respectively connected with fillers 5, 6 and 7. By providing those filters 5 to 7, it is possible to obtain the richness of the musical tones as well as the good S/N ratio of the musical tones. In FIG. 2, the parts identical to those shown in FIG. 1 are designated by the same numerals; hence, the description thereof will be omitted. As each of the filters 5 to 7, it is possible to employ one of the low-pass filter, band-pass filter, high-pass filter and band-elimination filter. One of those filters is selectively used to impart the specific characteristic to the musical tone signal.

The characteristics of the filters 5 to 7 are controlled by an output signal of an envelope generator (not shown) or they are controlled responsive to the tone-color parameter or key scale. Thus, it is possible to produce the musical tones having a relatively high degree of freedom.

[C]Third embodiment (1) Hardware configuration

Figure 3:
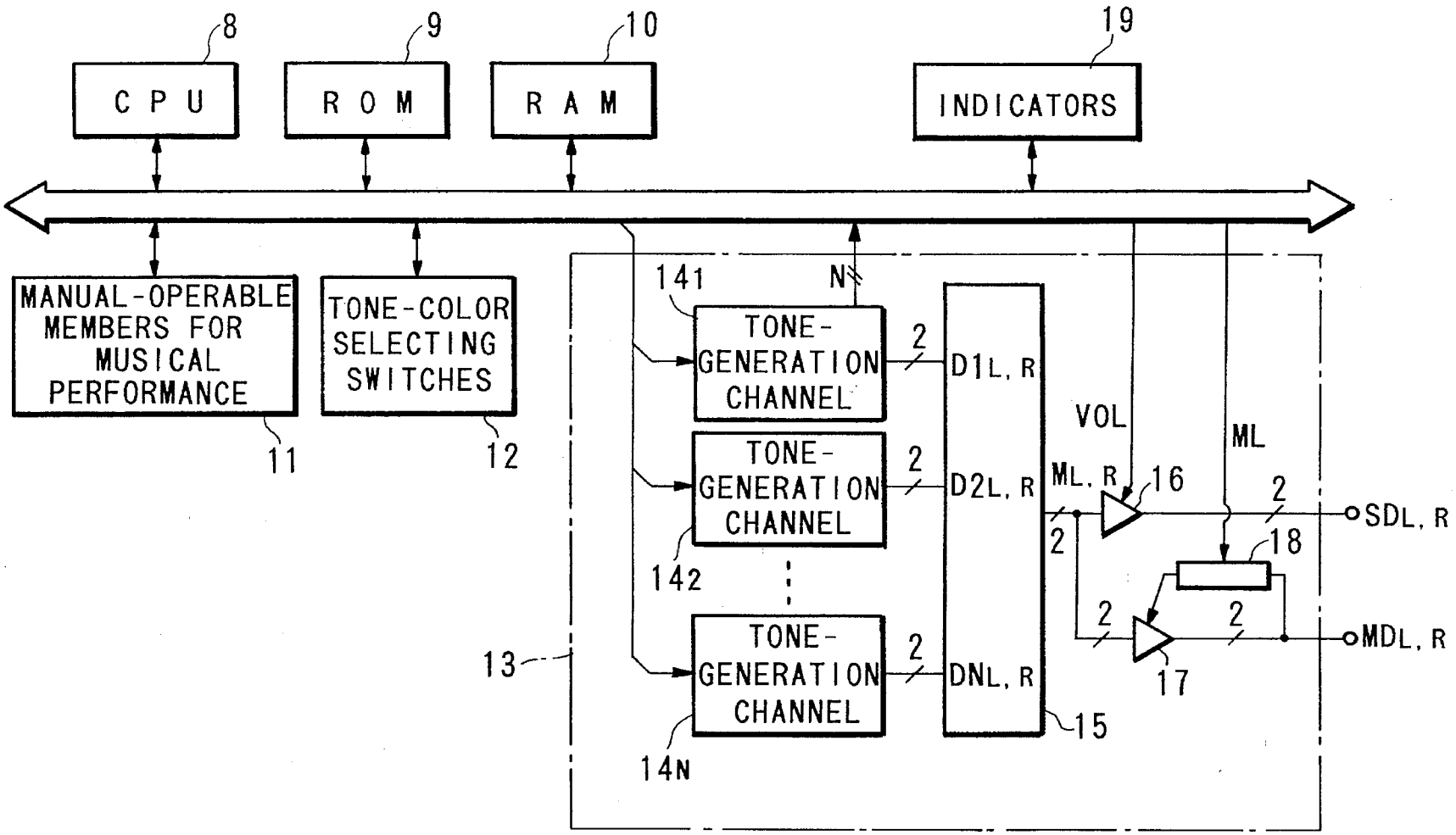
FIG. 3 is a block diagram slowing an electronic musical instrument employing a musical tone synthesizing apparatus according to a third embodiment of the present invention.

Next, a third embodiment of the present invention will be described. FIG. 3 is a block diagram showing an electronic musical instrument which employs a musical tone synthesizing apparatus according to the third embodiment of the present invention. In FIG. 3, a numeral 8 denotes a central processing unit (i.e., CPU) which controls each of circuit portions of the electronic musical instrument; 9 denotes a read-only memory (i.e., ROM) which stores several kinds of control programs and data, wherein the control programs are executed by the CPU 8 by use of the data; 10 denotes a random-access memory (i.e., RAM) in which working buffers and the like are provided; 11 denotes manual-operable members, such as the keys of the keyboard, which are used when carrying out the musical performance; 12 denotes tone-color selecting switches, each of which is used to select the tone color.

Further, a numeral 13 denotes a musical tone generating circuit providing a plurality of tone-generation channels $\mathbf{14}_1$, $\mathbf{14}_2 \ldots, \mathbf{14}_N$, the number of which is equal to "N". Each of the tone-generation channels generates the musical tone signals on the basis of several kinds of parameters, such as a tone-color parameter TC, which are transferred from the CPU 8. Each of them is capable of generating a pair of two-channel musical tone signals, i.e., a left-channel musical tone signal and a right-channel musical tone signal. Herein, the tone-generation channel $\mathbf{14}_1$ generates musical tone signals $D1_L$, $D1_R$; the tone-generation channel $\mathbf{14}_2$ generates musical tone signals $D2_L$, $D2_R$; and, the tone-generation channel $\mathbf{14}_N$ generates musical tone signals $DN_L$, $DN_R$, for example. Those musical tone signals are added together by an adder 15, from which two-channel musical tone signals $M_L$, $M_R$ are outputted. A numeral 16 denotes a multiplier which multiplies the musical tone signals $M_L$, $M_R$ by coefficient control data VOL which is given from the CPU 8. Thus, the multiplier 16 outputs multiplied musical tone signals $SD_L$, $SD_R$. A numeral 17 denotes a multiplier which outputs two-channel monitor signals $MD_L$, $MD_R$. An automatic level control circuit 18 detects levels of the monitor signals $MD_L$, $MD_R$ so as to automatically control those levels of the monitor signals to be identical to the predetermined level defined by monitor-level data ML which is transferred from the CPU 8. By controlling the levels of the monitor signals on the basis of the monitor-level data ML, the automatic level control circuit 18 adjusts the multiplication coefficient supplied to the multiplier 17 such that the musical tones are not suddenly produced with a high tone volume.

Furthermore, 19 denotes indicators which are used to visually display the signal level. For example, a plurality of light emitting diodes (i.e., LEDs) are linearly disposed on a panel face (not shown) as the indicators 19. The number of the LEDs to be turned on corresponds to the signal level at each moment. Some of the LEDs correspond to the maximum value of the signal level, and each of them has a specific color which is different from the color of the other LEDs. Hence, when the signal level becomes close to the maximum value, those LEDs having a specific color are turned on so as to give warning to the performer.

Figure 4:
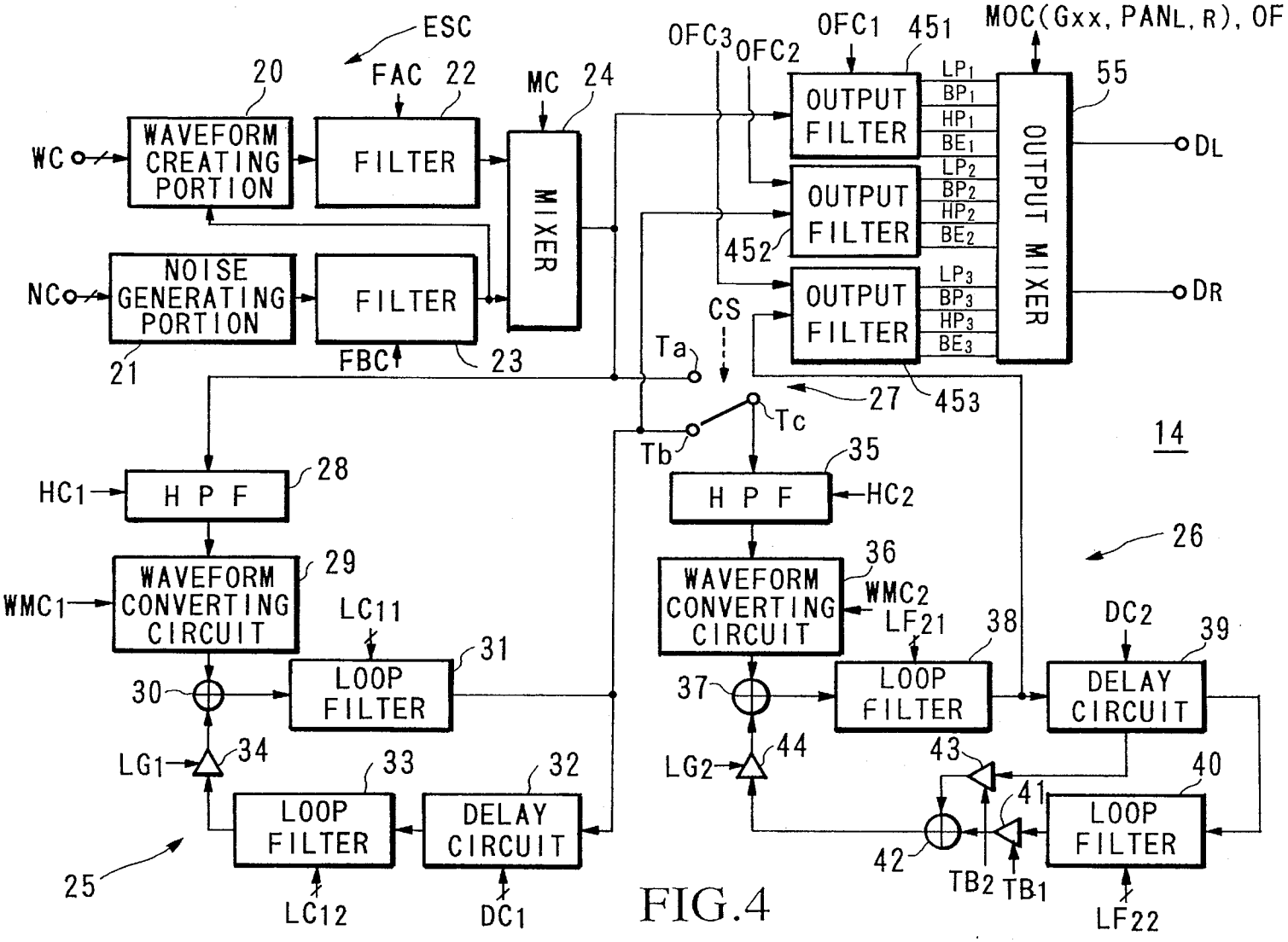
FIG. 4 is a block diagram showing a detailed configuration of a tone-generation channel shown in FIG. 3.

FIG. 4 is a block diagram showing an electronic configuration of each tone-generation channel "14". In FIG. 14, 20 denotes a waveform creating portion which creates a waveform signal, representing a predetermined waveform, on the basis of waveform control data WC given from the CPU 8. Herein, the waveform control data WC relates to the designation of the waveform, the designation of the timing at which the waveform signal is created and the designation of the pitch of the waveform signal to be created. Incidentally, any kinds of waveform creating methods can be employed for creating the waveform signal in the waveform creating portion 20. Among them, the waveform creating method utilizing the frequency modulation is preferable, because the fluctuation can be imparted to the waveform signal by modulating the waveform signal with the noise signal, which will be described later.

A noise generating portion 21 generates the aforementioned noise signal corresponding to the white noises and the like on the basis of noise control data NC given from the CPU 8. Numerals 22 and 23 denote filters which receive coefficient control data FAC and FBC respectively from the CPU 8. The filter 22 imparts a certain filtering characteristic, based on the coefficient control data FAC, to the waveform signal outputted from the waveform creating portion 20, while the filter 23 imparts another filtering characteristic, based on the coefficient control data FBC, to the noise signal outputted from the noise generating portion 21. A mixer 24 performs a mixing operation on output signals of the filters 22 and 23 on the basis of mixing control data MC given from the CPU 8.

The above-mentioned circuit elements 20 to 24 are assembled together to form an excitation-signal generating circuit ESC. An excitation signal (i.e., an output signal of the mixer 24) is continuously outputted from the excitation-signal generating circuit ESC in a duration between a key-on timing and a key-off timing with respect to each key to be depressed and then released. As described before, the manual-operable members 11 are the keys of the keyboard.

Each of numerals 25 and 26 denotes a loop circuit which is the main part of the delay-feedback-type tone generator. A switching operation of a switch 27 is controlled by switch control data CS. When a common terminal Tc is connected with a terminal Ta, the loop circuits 25 and 26 are connected in parallel. On the other hand, when the common terminal Tc is connected with a terminal TB, the loop circuits 25 and 26 are connected in series.

In the loop circuit 25, a high-pass filter (i.e., HPF) 28 operates based on coefficient control data $HC_1$. This high-pass filter 28 removes dc components, i.e., extremely-low-frequency components, from the output signal of the mixer 24. The reason why the high-pass filter 28 is provided will be described below.

Since the noise signal is used In the excitation-signal generating circuit ESC, the excitation signal itself should inevitably contain the extremely-low-frequency components included in the noise signal. The sign of the extremely-low-frequency component is not changed in a duration in which the signals are repeatedly added together in the loop circuit 25. So, the total value of those extremely-low-frequency components becomes larger and larger, by which the overflow event is easily caused in the loop circuit 25. Incidentally, another high-pass filter 35 in the loop circuit 26 is also provided under the consideration of the above reason.

A waveform converting circuit 29 has a non-linear characteristic which is controlled by waveform conversion control data $WMC_1$ given from the CPU 8. The waveform converting circuit 29 performs a predetermined waveform conversion on the input signal thereof. Under effects of the waveform conversion, the waveform of the input signal is distorted such that the overtone components are contained in the signal more and more. An adder 30 receives an output signal of the waveform converting circuit 29 at a first input thereof so as to output a result of addition to a loop filter 31. The loop filter 31 imparts a predetermined filtering characteristic, based on coefficient control data $LC_{11}$ given from the CPU 8, to an output signal of the adder 30. Then, an output signal of the loop filter 31 is delivered to the terminal Tb of the switch 27, a delay circuit 32 and an output filter $45_2$ which will be described later.

Based on delay control data $DC_1$ given from the CPU 8, the delay circuit 32 delays the output signal of the loop filter 31 by a predetermined delay time. A loop filter 33 imparts a predetermined filtering characteristic, based on coefficient control data $LC_{12}$ given from the CPU 8, to an output signal of the delay circuit 32. Then, an output signal of the loop filter 33 is supplied to a multiplier 34. In the multiplier 34, the output signal of the loop filter 33 is multiplied by loop-gain control data $LG_1$ given from the CPU 8; and then, a result of multiplication is supplied to a second Input of the adder 30. The delay time of the delay circuit 32 is set based on the delay control data $DC_1$ such that a total amount of the delay times of the delay circuit 32 and the loop filters 31 and 33 will coincide with the tone-pitch period of the musical tone whose production event is designated.

Next, in the loop circuit 26, the high-pass filter 35 receives either the output signal of the mixer 24 and the output signal of the loop filter 31 provided in the loop circuit 25 through the common terminal Tc of the switch 27. Herein, one of the output signals is selectively supplied to the high-pass filter 35 through the switch 27. Then, the high-pass filter 35 removes the extremely-low-frequency components of The input signal thereof under the control of the coefficient control data $HC_2$, wherein those components roughly correspond to the dc components. A waveform converting circuit 36 has a non-linear characteristic which is controlled by waveform conversion control data $WMC_2$ given from the CPU 8. Herein, the waveform converting circuit 36 receives an output signal of the high-pass filter 36 so as to convert it such that its waveform is distorted. Such distortion is performed such that the number of the overtone components is increased. An adder 37 receives an output signal of the waveform converting circuit 36 at a first input thereof. Then, the adder 37 outputs a result of addition to a loop filter 38.

The loop filter 38 imparts a predetermined filtering characteristic, based on coefficient control data $LF_{21}$ given from the CPU 8, to the result of addition outputted from the adder 37. Then, an output signal of the loop filter 38 is delivered to a delay circuit 39 and an output filter $\mathbf{45}_3$ which will be described later. The delay circuit 39 delays an output signal of The loop filter 38 by a delay time based on delay control data $DC_2$ given from the CPU 8. This delay circuit 39 provides a tap terminal from which an auxiliary output signal (or a tap output signal) is outputted. This tap output signal is obtained by delaying the output signal of the loop filter 38 by a certain delay time which is shorter than the delay time of the delay circuit 39 set by the delay control data $DC_2$. A loop filter 40 imparts a filtering characteristic, based on coefficient control data $LF_{22}$ given from the CPU 8, to the output signal of the delay circuit 39. Then, an output signal of the loop filter 40 is supplied to a multiplier 41. As similar to the aforementioned delay circuit 32, the delay circuit 39 has the delay time which is controlled by the delay control data $DC_2$ such that the total delay time, which is a sum of the delay times of the loop filter 38, 40 and the delay time of the delay circuit 39, will coincide with the tone-pitch period of the musical tone to be produced.

The multiplier 41 multiplies the output signal of the loop filter 40 by tap-balance control data $TB_1$. Then, a result of multiplication of the multiplier 41 is supplied to a first input of an adder 42. A multiplier 43 multiplies the tap output signal from the delay circuit 39 by tap-balance control data $TB_2$ given from the CPU 8. Then, a result of multiplication of the multiplier 43 is supplied to a second input of the adder 42. The adder 42 adds the output signals of the multipliers 41 and 43 together so as to produce a result of addition, which is supplied to a multiplier 44. The multiplier 44 multiplies the output signal of the adder 42 by loop-gain control data $LG_2$ given from the CPU 8. Then, a result of multiplication of the multiplier 44 is supplied to a second input of the adder 37.

Fundamentally, both of the loop circuits 25 and 26 have the similar configuration. Different from the aforementioned loop circuit 25, the loop circuit 26 can mix the tap output signal and the output signal of the loop filter 40 by an arbitrary ratio. Thus, as compared to the loop circuit 25, the loop circuit 26 can perform a precise control or a varied control on the loop characteristic thereof.

Numerals $\mathbf{45}_1$ to $\mathbf{45}_3$ denote output filters whose filtering characteristics are controlled by output-filter control data $OFC_1$to $OFC_3$ respectively. Herein, the output filter $\mathbf{45}_1$ imparts a filtering characteristic to the output signal of the mixer 24; the output filter 452 imparts a filtering characteristic to the output signal of the loop circuit 25; and the output filter 453 imparts a filtering characteristic to the output signal of the loop circuit 26.

Figure 5:
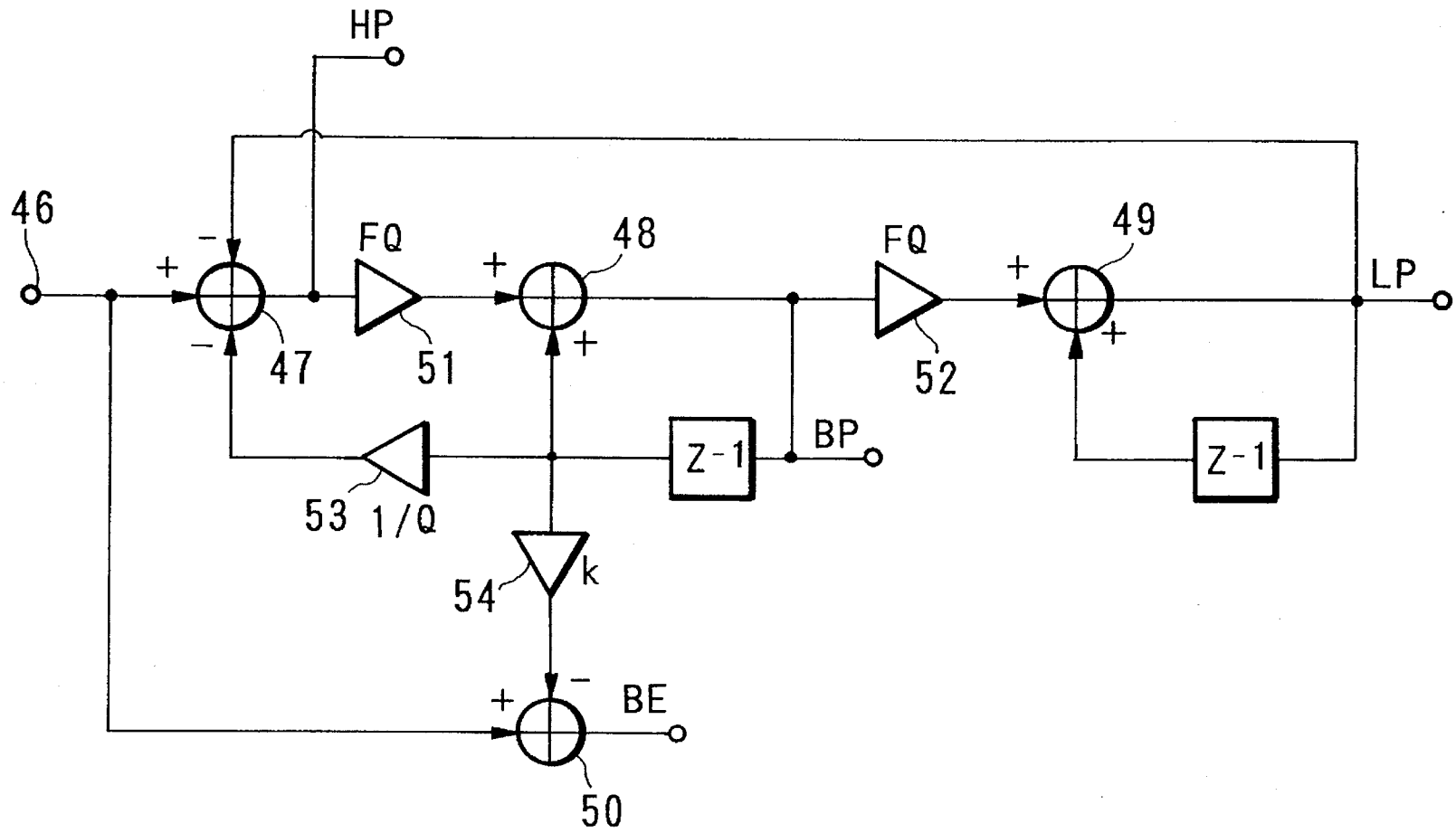
FIG. 5 is a block diagram showing a detailed configuration of an output filter shown in FIG. 4.

FIG. 5 shows an example of the filter configuration which can be employed for the output filters $\mathbf{45}_{1-453}$, the filters 5–7, 22, 23 and the loop filters 31, 33, 38 and 40. This filter is a digital filter which is obtained by digitally re-designing an analog filter called a voltage-controlled filter. In the digital re-designing, calculation elements used In characteristic formulae of the above-mentioned analog filter are translated into digital-circuit elements respectively. For example, an addition is translated into an adder; a subtraction is translated into a subtracter, an adder or an inverter; a multiplication is translated into a multiplier; and an integration is translated into an accumulator. Thus, the filter shown in FIG. 5 is designed based on the analog filter but can be digitally controlled.

In FIG. 5, an input signal is applied to an input terminal 46. Herein, a signal HP which is obtained by imparting a high-pass filtering characteristic to the input signal is outputted from an adder 47; a signal BP which is obtained by imparting a band-pass filtering characteristic to the input signal is outputted from an adder 48; a signal LP which is obtained by imparting a low-pass filtering characteristic to the input signal is outputted from an adder 49; and a signal BE which is obtained by imparting a band-elimination filtering characteristic to the input signal is outputted from an adder 50.

In the case of the output filter (i.e., $\mathbf{45}_1$–$\mathbf{45}_3$), multiplication coefficients of multipliers 51–54 can be changed by the output-filter control data (i.e., $OFC_1$–$OFC_3$) given from the CPU 8. When a multiplication coefficient FQ used for each of the multipliers 51 and 52 is changed, a cut-off frequency is changed. When a multiplication coefficient 1/Q used for the multiplier 53 is changed, a factor Q is changed. When a multiplication coefficient k used for the multiplier 54 is changed, an elimination band of the band-elimination filter is changed.

In FIG. 4, the output filter $\mathbf{45}_1$ outputs signals LP1, BP1, HP1 and BE1; the output filter $\mathbf{45}_2$ outputs signals LP2, BP2, HP2 and BE2; and the output filter $\mathbf{45}_3$ outputs signals LP3, BP3, HP3 and BE3. Those signals are supplied to an output mixer 55 in which they are mixed together to form two-channel musical tone signals $D_L$, $D_R$ on the basis of output-mixing-control data MOC given from the CPU 8. The output-mixing-control data MOC contain gain control data Gxx and panning control data $PAN_L$, $PAN_R$.

Several kinds of control data described heretofore are determined by tone-color data corresponding to a tone-color number representing a specific tone color which is selected when the performer operates the tone-color selecting switches 12. In addition, they can be also determined by a keycode KC or touch data TOUCH. Incidentally, the tone-color data are stored in the ROM 9 and/or the RAM 10 with respect to each tone-color number.

Figure 6:
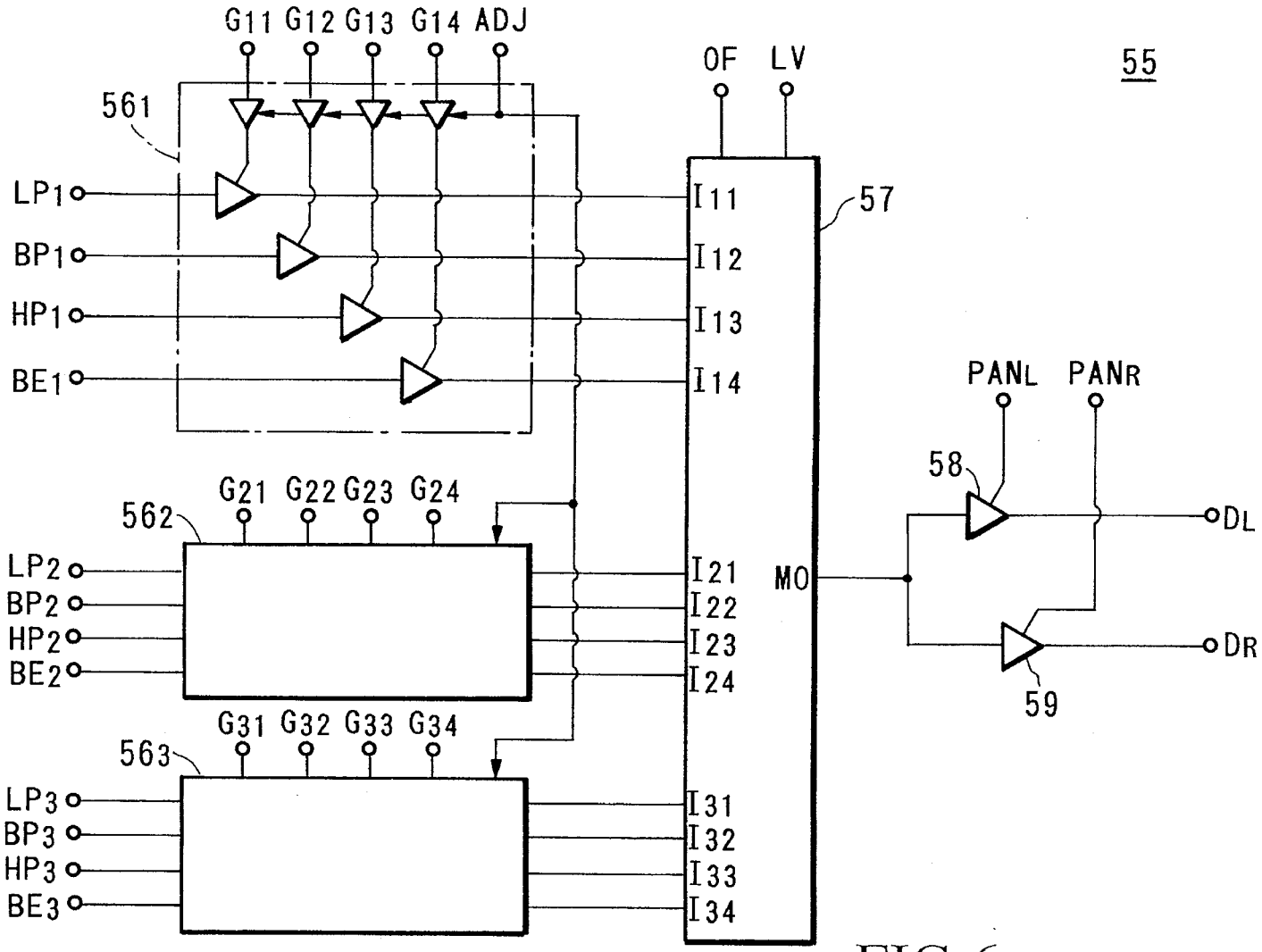
FIG. 6 is a block diagram showing a detailed configuration of an output mixer shown in FIG. 4.

FIG. 6 shows an example of the output mixer 5S. In FIG. 6, numerals 561 to 563 denote weighting devices, each of which is configured by plural multipliers. Each of the weighting devices $\mathbf{56}_1$ to $\mathbf{56}_3$ performs weighting operations on input signals thereof on the basis of weighting coefficient data given from the CPU 8. Herein, the weighting device $\mathbf{56}_1$ inputs the signals LP1, BP1, HP1, BE1 as well as weighting coefficient data $G_{11}$, $G_{12}$, $G_{13}$, $G_{14}$; the weighting device $\mathbf{56}_2$ inputs the signals LP2, BP2, HP2, BE2 as well as weighting coefficient data $G_{21}$, $G_{22}$, $G_{23}$, $G_{24}$; and, the weighting device $\mathbf{56}_3$ inputs the signals LP3, BP3, HP3, BE3 as well as weighting coefficient data $G_{31}$, $G_{32}$, $G_{33}$, $G_{34}$. Four output signals of the weighting device $\mathbf{56}_1$ are supplied to input terminals $I_{11}$ to $I_{14}$ of an adding device 57. Similarly, four output signals of the weighting device $\mathbf{5}_{62}$ are supplied to input terminals $I_{21}$ to $I_{24}$ of the adding device 57; and, four output signals of the weighting device $\mathbf{56}_3$ are supplied to input terminals $I_{31}$ to $I_{34}$ of the adding device 57. Thus, total twelve signals are added together by the adding device 57. Then, a result of addition of the adding device 57 is outputted from an output terminal MO.

The above-mentioned adding device 57 also outputs a level signal LV representing a signal level of the result of addition. Further, when the signal level exceeds the maximum value which is defined by the number of bits used for the data in the adding device 57, the adding device 57 produces an overflow signal OF, which is supplied to the CPU 8. When receiving the overflow signal OF, the CPU 8 produces adjustment data ADJ, which is delivered to the weighting devices $\mathbf{56}_1$ to $\mathbf{56}_3$. The adjustment data ADJ is used to reduce, at equal rate, the multiplication coefficients which are used in the weighting devices $\mathbf{56}_1$ to $\mathbf{56}_3$ and which correspond to the weighting coefficient data $G_{11}$–$G_{14}$, $G_{21}$–$G_{24}$ and $G_{31}$–$G_{34}$ respectively.

A multiplier 58 multiplies the output signal of the adding device 57 by the panning control data $PAN_L$ so as to produce a left-channel musical tone signal $D_L$. A multiplier 59 multiplies the output signal of the adding device 57 by the panning control data $PAN_R$ so as to produce a right-channel musical tone signal $D_R$.

In the present embodiment, the tone-generation channel 14 is configured by hardware portions as shown in FIGS. 4–6. However, it is possible to embody the operations of the tone-generation channel 14 by the software processing whose programs are executed by a digital signal processor (i.e., DSP).

(2) Software processing

Next, the software processing of the CPU 8 will be described by referring to the flowcharts shown in FIGS. 7 and 8.

Figure 7:
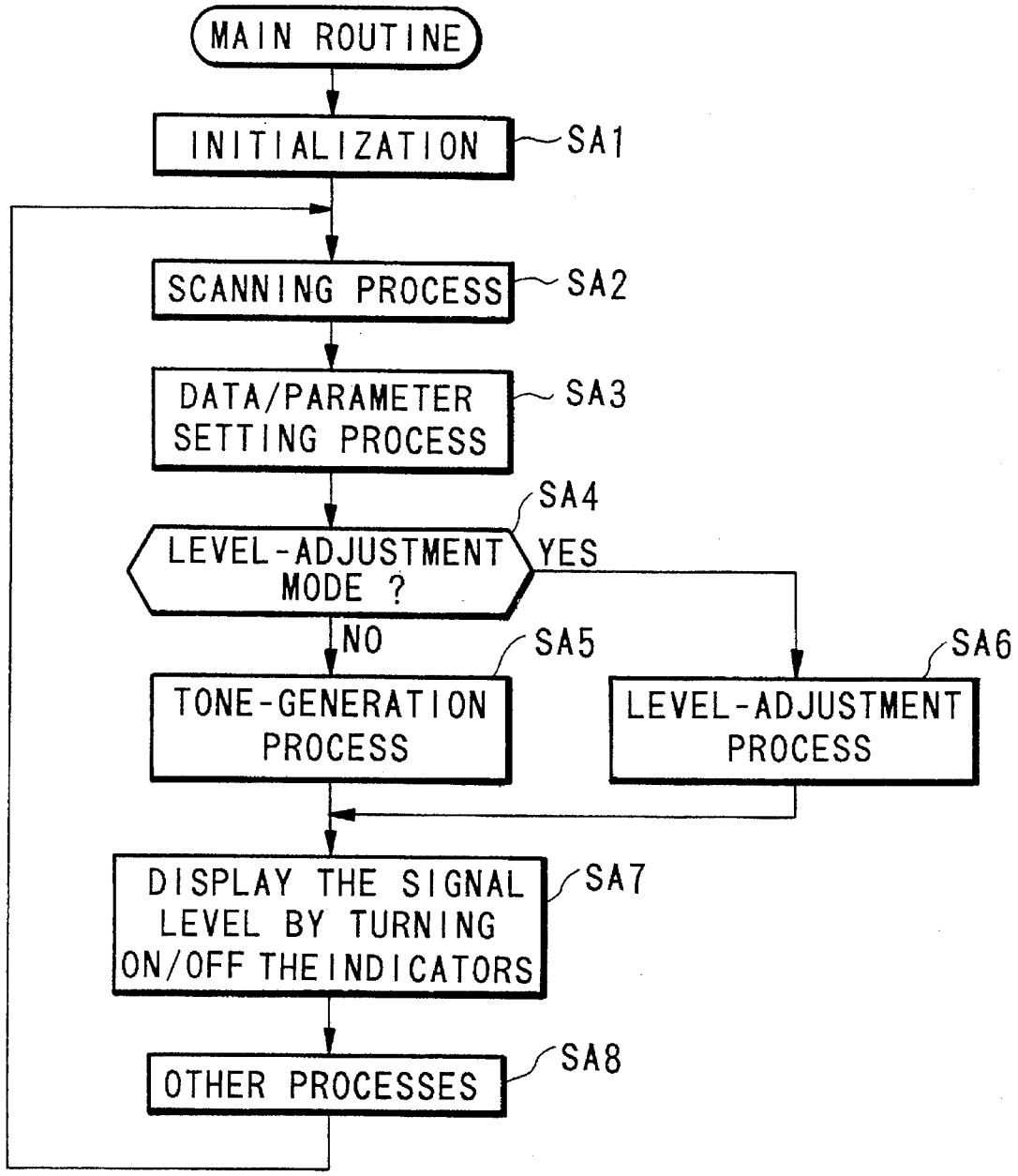
FIG. 7 is a flowchart showing a main routine whose processes are executed by a CPU shown in FIG. 3.

When an electric power is applied to the electronic musical instrument shown in FIG. 3, the processing of the CPU 8 proceeds to step SA1 in the main routine shown in FIG. 7. In step SA1, the CPU 8 performs a initialization process on each of circuit portions of the electronic musical instrument. According to the initialization process, values stored in registers are reset to zero, while several kinds of variables are set at initial values so as to initialize states of peripheral circuits. Then, the processing of the CPU 8 advances to step SA2.

In step SA2, a scanning process is carried out to scan current operating states of the manual-operable members 11 and the tone-color selecting switches 12. Thus, key-depression/release states of each key is detected, while an operating state of each switch is detected. After completing the process of step SA2, the processing advances to step SA3.

In step SA3, data/parameter setting process is carried out in response to the key-depression/release state of each key and/or the operating state of each switch which are detected by executing the scanning process of step SA2. According to the data/parameter setting process in step SA3, the CPU 8 sets a key-event flag, the keycode KC and the touch data TOUCH with respect to the key whose key event is detected; and the CPU 8 also sets several kinds of parameters in response to the tone-color selecting switch whose operation is detected. Thereafter, the processing advances to step SA4.

In step SA4, it is judged whether or not a level-adjustment mode is set. When the performer turns on a level-adjustment switch provided in the manual-operable members 11, the CPU 8 detects a turn-on event of that switch by executing the scanning process of step SA2, so that the CPU 8 sets the level-adjustment mode. At this time, by executing the data/parameter setting process of step SA3, a process-end flag FLG is reset to zero. This process-end flag FLG is set at "1" when a level-adjustment process is completed. If a result of judgement in step SA4 is "NO", the processing advances to step SA5.

In step SA5, the CPU 8 performs a tone-generation process in which the musical tones are produced responsive to the performance played on the keyboard by the performer. The tone-generation process corresponds to the normal performance of the electronic musical instrument, and the contents thereof is well known; hence, the description thereof will be omitted. When completing the tone-generation process, the processing of the CPU 8 advances to step SA7.

Meanwhile, when the result of judgement in step SA4 turns to "YES", in other words, when it is judged that the level-adjustment mode is set, the processing branches to step SA6.

In step SA6, the CPU 8 sends the adjustment data ADJ to each of the weighting devices $\mathbf{56}_1$ to $\mathbf{56}_3$ provided in the output mixer 55 so as to perform the level-adjustment process. In the level-adjustment process, output levels of the weighting devices $\mathbf{56}_1$ to $\mathbf{56}_3$ are adjusted respectively. The details of the level-adjustment process will be described later. When completing the level-adjustment process, the processing of the CPU 8 advances to step SA7.

In step SA7, the LEDs provided as the indicators 19 are turned on in response to the level signal LV outputted from the adding device 57 (see FIG. 6). Then, the processing advances to step SA8.

In step SA8, other processes are carried out. After completing those processes of step SA8, the processing of the CPU 8 returns back to step SA2. Hence, until the electric power is cut off, the aforementioned processes of steps SA2 to SA8 are repeatedly performed.

Next, the contents of the level-adjustment process to be executed by the CPU 8 will be described by referring to FIG. 8.

Figure 8:
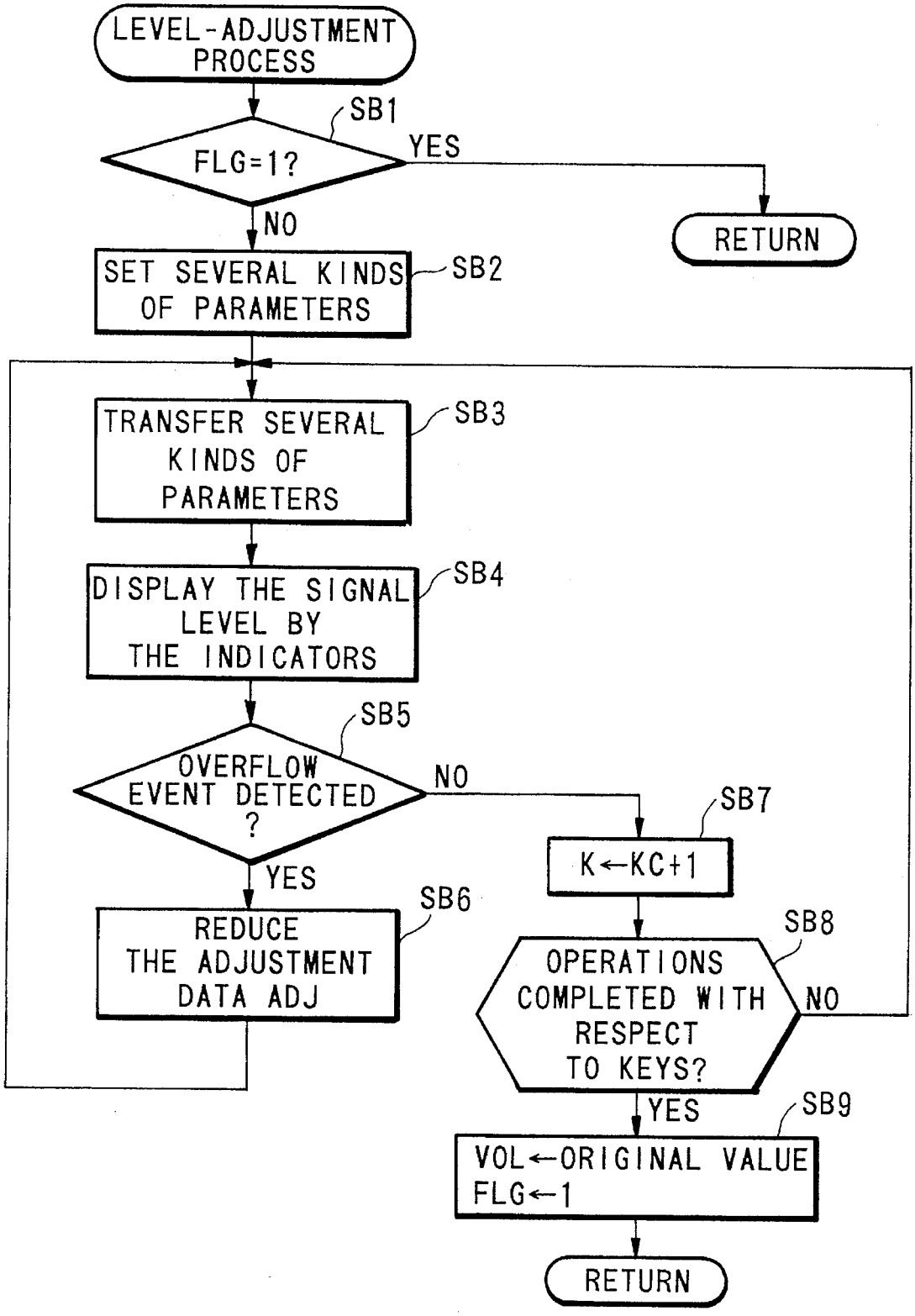
FIG. 8 is a flowchart showing a routine of level-adjustment process to be executed by the CPU.

When the processing of the CPU 8 reaches step SA6 in FIG. 7, a routine of level-adjustment process as shown in FIG. 8 is started. Firstly, the processing of the CPU 8 proceeds to step SB1, wherein it is judged whether or not the process-end flag FLG is set at "1". If a result of judgement in step SB1 is "YES", the processing directly returns back to the main routine shown in FIG. 7 without substantially performing any of the processes provided in the routine of level-adjustment process. In this case, the processing goes to step SA7 from seep SB1.

In contrast, when the result of judgement in step SB1 is "NO", in other words, when it is judged that the process-end flag FLG is reset to zero, the processing of the CPU 8 advances to step SB2.

In step SB2, several kinds of parameters are set. More specifically, the adjustment data ADJ is set at the maxima value "1", while in order to perform the level adjustment on the keyboard from the key having the lowest pitch, the keycode KC is set at "1". Further, In order to prevent the two-channel musical tone signals $SD_L$, $SD_R$ from being outputted from the musical tone generating circuit 13 (see FIG. 3), the coefficient control data VOL used for the multiplier 16 is set at "0".

Furthermore, the monitor-level data ML is set at a predetermined value in order that the two-channel monitor signals $MD_L$, $MD_R$ are outputted at desired levels set by the performer. Incidentally, the performer listens to sounds corresponding to the monitor signals $MD_L$, $MD_R$ by using the headphone set, for example. Even when the largest sound is produced, in other words, even when the performer depresses the key with the strongest key-depressing force, It is necessary to avoid the overflow event of the musical tone signals $SD_L$, $SD_R$. In order to do so, it is necessary to set the value of the touch data TOUCH at its maximum value in step SB2. Then, the processing advances to step SB3.

In step SB3, on the basis of several kinds of parameters, such as the keycode KC and touch data TOUCH, which are set by the process of step SB2, a tone-color parameter TC is created; and then, the tone-color parameter TC together with the adjustment data ADJ, coefficient control data VOL and monitor-level data ML are transferred to the musical tone generating circuit 13. Thereafter, the processing advances to step SB4.

Thus, a certain tone-generation channel 14 in the musical tone generating circuit 13 is activated to generate a musical tone signal, whose level is not adjusted, on the basis of the tone-color parameter TC transferred thereto. However, since the coefficient control data VOL has been set at "0", the multiplier 16 in the musical tone generating circuit 13 does not output the musical tone signals $SD_L$, $SD_R$. Meanwhile, the automatic-level control circuit 18 detects the levels of the monitor signals $MD_L$, $MD_R$ outputted from the multiplier 17. The automatic-level control circuit 18 adjusts the multiplication coefficient used for the multiplier 17 such that the detected levels of the monitor signals $MD_L$, $MD_R$ become equal to the level indicated by the monitor-level data ML. Therefore, the multiplier 17 outputs the monitor signals $MD_L$, $MD_R$ whose levels are adjusted according to the needs of the performer.

In step SB4, the LEDs provided for the indicators 19 are turned on in response to the level signal LV outputted from the adding device 57. Then, the processing advances to step SB5.

In step SB5, it is judged whether or not the overflow event is detected. This Judgement is performed by detecting whether or not the adding device 57, provided in the output mixer 55 of the certain tone-generation channel 14, outputs the overflow signal OF. If a result of judgement is "YES", the processing advances to step SB6.

In step SB6, the adjustment data ADJ is reduced by a predetermined amount of value (preferably, a very small amount of value). After completing the process of step SB6, the processing returns back to step $SB_3$. Thus, the processes of steps SB3 to SB6 are repeatedly performed, so that the tone-generation channel 14 now generates the musical tone signal whose level has been adjusted. After those processes of steps SB3 to SB6 are repeatedly performed by several times, the adding device 57 does not output the overflow signal OF. In this case, the result of judgement in step SB5 turns to "NO", so that the processing of the CPU 8 branches to step SB7 from step SB5.

In step SB7, in order to perform the level adjustment with respect to the key to be designated next, the keycode KC is incremented by "1". Thereafter, the processing advances to step SB8.

In step SB8, it is judged whether or not the level adjustment has been completed with respect to all of the keys. If a result of judgement in step SB8 is "NO", the processing returns back to step SB3. Thus, the aforementioned processes of steps SB3 to SB6 are repeated with respect to the key newly designated.

If the result of judgement in step SB8 turns to "YES", in other words, if it is judged that the level adjustment has been already completed with respect to all of the keys, the processing advances to step SB9.

In step SB9, the current value of the coefficient control data VOL is returned to its original value which has been set as the coefficient control data VOL before executing the routine of level-adjustment process; and, the process-end flag FLG is set at "1". Thereafter, the processing returns back to the main routine shown in FIG. 7, wherein the processing advances to step SA7 from step SA6.

Thus, until the performer turns off the level-adjustment switch provided in the manual-operable members 11 so as to release the level-adjustment mode, the CPU 8 does not perform any processing.

As described above, the present embodiment can automatically determine the adjustment data ADJ representing the optimum tone volume, by which the complete range of values, defined by the predetermined number of bits employed by the present embodiment, can be efficiently used without causing the overflow event.

[D]Modified examples

In the third embodiment described heretofore, the level-adjustment process Is carried out with respect to each keycode KC, i.e., each musical tone. However, the third embodiment can be modified to cope with the polyphonic system in which the plural musical tones can be simultaneously produced. In this case, the third embodiment is modified such that the plural overflow events occurred in the plural tone-generation channels can be simultaneously detected and the level adjustment can be performed simultaneously with producing the plural musical tones.

In addition, the third embodiment can perform an automatic level adjustment to eliminate the overflow event which happens in the output mixer 55 of the tone-generation channel 14. However, the present invention is not limited to that embodiment. The present invention can be embodied such that the overflow event is detected with respect to each of the operational elements, such as the adders 30, 37.42, the multipliers 34, 41, 43, 44 and the loop filters 31, 33, 38, 40 in the loop circuits 25 and 26 provided in each tone-generation channel 14, so as to adequately adjust the input level of each loop circuit in accordance with the procedure which is similar to that of the third embodiment.

Figure 9:
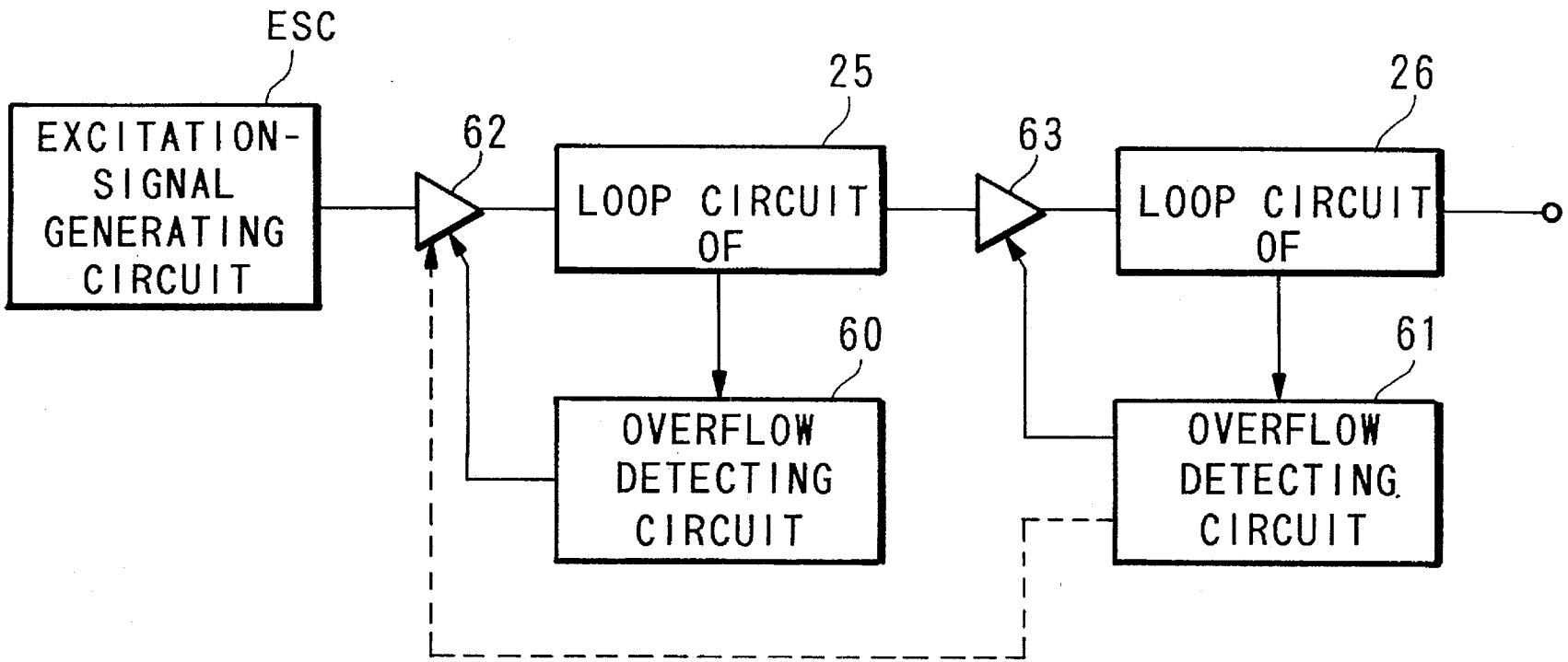
FIG. 9 is a block diagram showing a musical tone synthesizing apparatus according to a modified example of the present invention.

As described before, by connecting the common terminal Tc with the terminal Tb in the switch 27 (see FIG. 4), the loop circuits 25 and 26 are connected in series. In this case, the musical tone synthesizing apparatus according to the present invention can be re-designed as shown in FIG. 9. In FIG. 9, the loop circuits 25 and 26 are connected in series through a multiplier 63; and a multiplier 62 is also inserted between the excitation-signal generating circuit ESC and the loop circuit 25. Herein, an overflow detecting circuit 60 detects the overflow signal OF outputted from the loop circuit 25, while another overflow detecting circuit 61 detects the overflow signal 0F outputted from the loop circuit 26. Thus, the overflow detecting circuit 60 adjusts the multiplication coefficient used in the multiplier 62 so as to adjust the input level of the loop circuit 25, while the overflow detecting circuit 61 adjusts the multiplication coefficient used in the multiplier 63 so as to adjust the input level of the loop circuit 26.

In FIG. 9, the line connection among the circuit elements can be changed as shown by a dotted line such that the overflow detecting circuit 61 does not control the multiplier 63 but the multiplier 62 which is coupled with the loop circuit 25.

Figure 10:
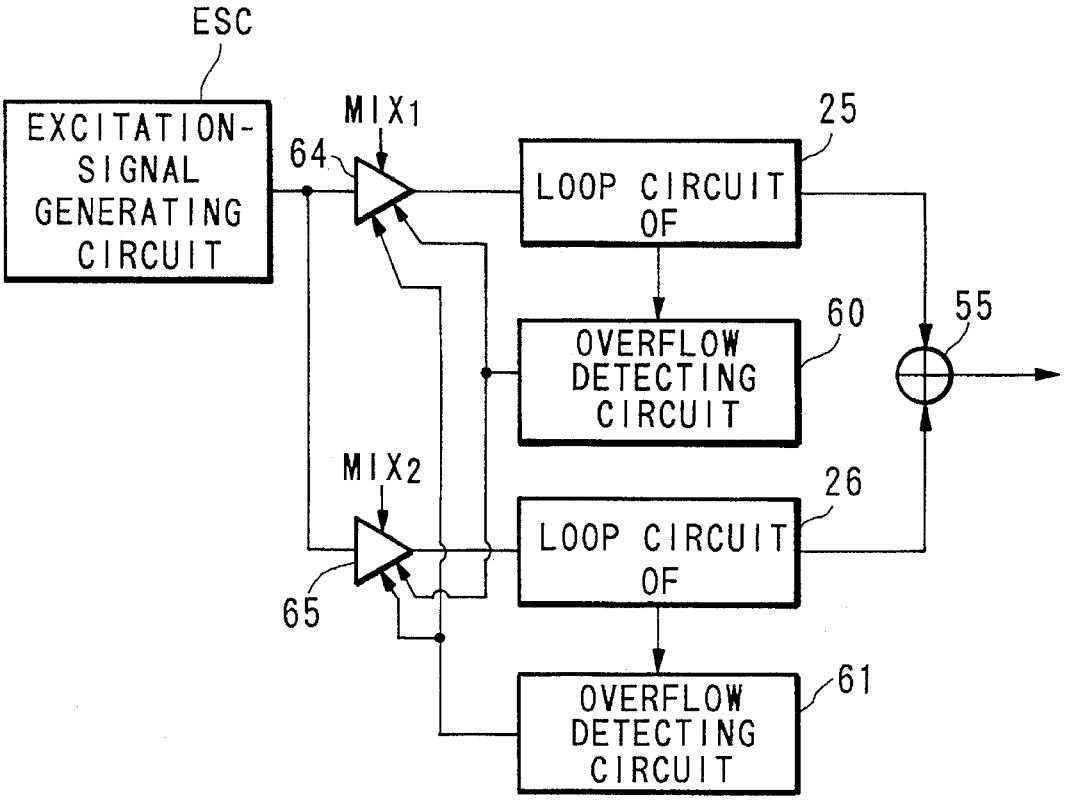
FIG. 10 is a block diagram showing a musical tone synthesizing apparatus according to another modified example of the present invention.

In contrast, by connecting the common terminal Tc with the terminal Ta in the switch 27 shown in FIG. 4, the loop circuits 25 and 26 can be connected in parallel. In this case, the musical tone synthesizing apparatus according to the present Invention can be re-designed as shown in FIG. 10. In FIG. 10, parts identical to those shown in FIG. 9 are designated by the same numerals. Herein, the overflow detecting circuits 60 and 61 detect the overflow signals of the loop circuits 25 and 26 respectively. In addition, a multiplier 64 is inserted between the excitation-signal generating circuit ESC and the loop circuit 25, while another multiplier 65 is inserted between the excitation-signal generating circuit ESC and the loop circuit 26. The overflow detecting circuit 60 adjusts multiplication coefficients respectively used for the multipliers 64 and 65, while the overflow detecting circuit 61 adjusts multiplication coefficients respectively used for the multipliers 64 and 65. Thus, the input levels of the loop circuits 25 and 26 are respectively controlled. In this case, coefficient control data $MIX_1$, $MIX_2$ transferred from the CPU 8 are respectively supplied to the multipliers 64 and 65; however, a ratio between those data $MIX_1$, $MIX_2$ is not changed. Because, this ratio is directly determined by the tone color to be currently used.

Figure 11:
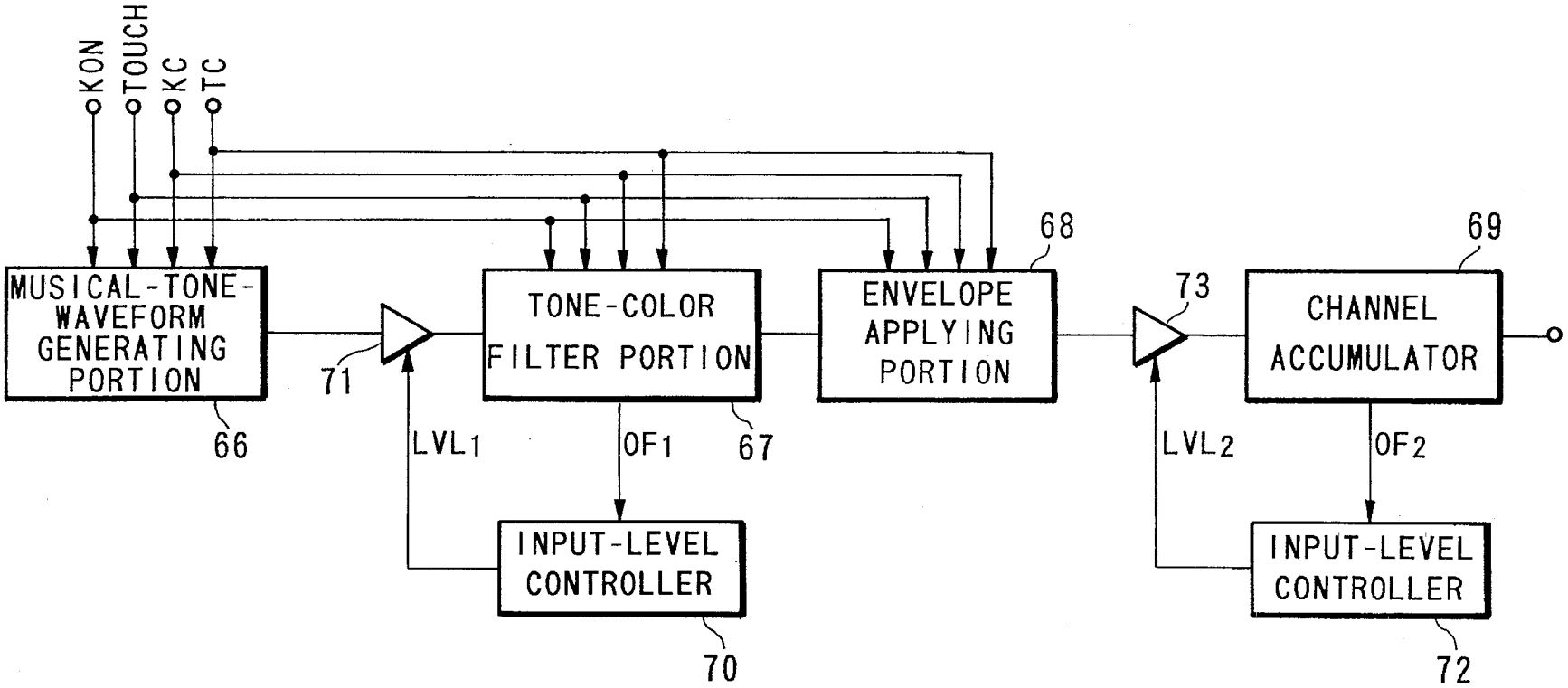
FIG. 11 is a block diagram showing a musical tone synthesizing apparatus according to a further modified example of the present invention.
Figure 12:
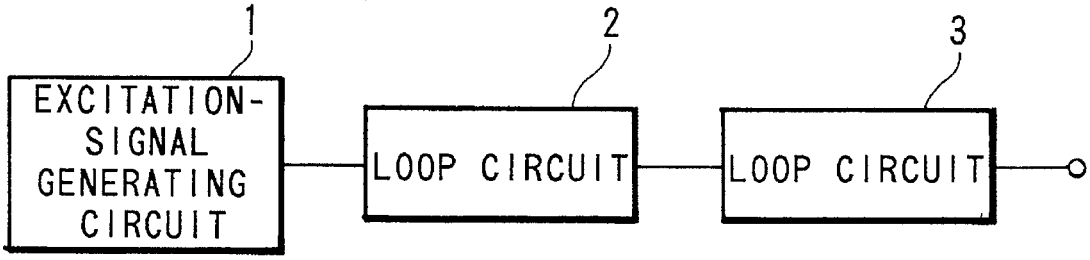
FIG.12 (PRIOR ART)
FIG. 12 is a block diagram showing an example of the conventional musical tone synthesizing apparatus.

Moreover, the fundamental configuration of the present invention can be applied to the general-use musical tone synthesizing apparatus as well. In this case, the musical tone synthesizing apparatus can be configured as shown in FIG. 11. In FIG. 11, a musical-tone-waveform generating portion 66 generates a musical tone signal, having a predetermined musical-tone waveform, on the basis of a key-on signal KON in addition to the touch data TOUCH, keycode KC and tone-color parameter TC. Next, a tone-color filter portion 67 imparts a tone-color property to the musical tone signal; and then, an envelope applying portion 68 applies an envelope property to an output signal of the tone-color filter portion 67. Thus, the envelope applying portion 68 outputs a plurality of musical tone signals, the values of which are accumulated by a channel accumulator 69 in a time-division manner.

When an overflow event is occurred in the tone-color filter portion 67, the tone-color filter portion 67 outputs an overflow signal $OF_1$, which is monitored by an input-level controller 70. By intentionally depressing each of the keys provided In the keyboard with a high key-depression intensity, the musical-tone-waveform generating portion 66 generates a musical tone signal, using a predetermined tone color, whose level is very high. In that case, the overflow event can be intentionally caused in the tone-color filter portion 67. Hence, the input-level controller 70 is activated to control a multiplication coefficient $LVL_1$ used in a multiplier 71 which is provided between the musical-tone-waveform generating portion 66 and the tone-color filter portion 67. Herein, the input-level controller 70 sets the multiplication coefficient $LVL_1$ at a maximum value representing a range of values within which the overflow event is not occurred in the tone-color filter portion 67. By repeatedly performing the above-mentioned operations with respect to all of the keys provided in the keyboard. It is possible to set the maximum value with respect to all of the keys.

Similarly, when an overflow event is occurred in the channel accumulator 69, the channel accumulator 69 outputs an overflow signal $0F_2$, which is monitored by an input-level controller 72. Now, the musical-tone-waveform generating portion 66 is controlled to generate a plurality of musical tone signals, each having a predetermined tone color and a predetermined keycode KC, with the touch data TOUCH having a high level. In that case, the overflow event can be intentionally caused in the channel accumulator 69. Hence, the input-level controller 72 is activated to control a multiplication coefficient $LVL_2$ used for a multiplier 73 which Is provided between the envelope applying portion 68 and the channel accumulator 69. Herein, the input-level controller 72 sets the multiplication coefficient $LVL_2$ at a maximum value representing a range of values within which the overflow event is not occurred.

Incidentally, the overflow event will not be occurred in the channel accumulator 69 as long as the number of bits employed for the channel accumulator 69 is not less than the number represented by "m+log2N", wherein a symbol "N" represents the number of channels and a symbol "m" represents the number of bits used for the musical tone signal in each channel. If the number of bits employed for the channel accumulator 69 cannot be set at "m+log2N" or more in order to reduce the cost for manufacturing the hardware system, special circuits or special processing for avoiding the overflow event should be further required for the apparatus shown in FIG. 11.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A musical tone synthesizing apparatus comprising:

excitation-signal generating means for generating an excitation signal;

loop means, having a comb-like frequency characteristic, responsive to introduction of said excitation signal into said loop means for repeatedly circulating said introduced excitation signal while delaying said introduced excitation signal by a delay time which is set substantially identical to a tone-pitch period of a musical tone to be produced; and mixing means for mixing said excitation signal with a signal extracted from said loop means to produce a musical tone signal.

2. A musical tone synthesizing apparatus comprising:

excitation-signal generating means for generating an excitation signal;

loop means, having a comb-like frequency characteristic, responsive to introduction of said excitation signal into said loop means for repeatedly circulating said introduced excitation signal while delaying said introduced excitation signal by a delay time which is set substantially identical to a tone-pitch period of a musical tone to be produced; and a first filter for performing a filtering operation using a first frequency characteristic on a signal which is extracted from said loop means;

a second filter for performing a filtering operation using a second frequency characteristic on said excitation signal; and mixing means for mixing an output signal of said first filter with an output signal of said second filter.

3. A musical tone synthesizing apparatus as defined in claim 1 or 2 wherein said excitation signal is generated by mixing a noise signal and a wave form signal having a predetermined waveform.

4. The apparatus of claim 2, wherein said mixing means produces a musical tone signal.

5. A musical tone synthesizing apparatus comprising:

musical tone waveform generating means having a loop configuration containing a delay for generating a plurality of waveform signals;

adding means for adding said plurality of waveform signals together to produce a musical tone signal;

detecting means for detecting a signal level of an output signal of said adding means; and adjusting means for adjusting at least one of said plurality of waveform signals on the basis of a result of detection of said detecting means.

6. The apparatus of claim 5, wherein said detecting means further includes means for determining whether said signal level of said output of said adding means exceeds a predetermined limit, and said adjusting means further includes means for adjusting at least one of said plurality of waveform signals so that said signal level of said output of said adding means does not continue to exceed said predetermined limit.

7. A musical tone synthesizing apparatus comprising:

musical tone waveform generating means having a loom configuration containing a delay for generating a plurality of waveform signals;

adding means for adding said plurality of waveform signals together to produce a musical tone signal;

detecting means for detecting a signal level of an output signal of said adding means;

adjusting means for adjusting at least one of said plurality of waveform signals on the basis of a result of detection of said detecting means; and displaying means for displaying the signal level on the basis of the result of detection of said detecting means.

8. A musical tone synthesizing apparatus comprising:

excitation-signal generating means for generating an excitation signal;

at least two loop means, each having a comb-like frequency characteristic, which are connected in series so that said excitation signal is supplied to one loop means, while an output signal of said one loop means is supplied to another loop means, each of said two loop means repeatedly circulating its input signal therethrough while delaying the input signal by a delay time which is set responsive to a tone-pitch period of a musical tone to be produced;

filter means for performing a filtering operation on at least one of output signals of said two loop means; and mixing means for mixing output signals of said two loop means together.

9. A musical tone synthesizing apparatus as defined in claim 8 further comprising an overflow detecting means for determining whether a signal level circulating within one of said loop means exceeds a predetermined limit within an operational element of said one of said loop means.

10. A musical tone synthesizing apparatus as defined in claim 9 wherein said overflow detecting means comprises an adder inputting a feedback signal.

11. The apparatus of claim 8, wherein said mixing means produces a musical tone signal.

12. The apparatus of claim 8, wherein one of said at least two loop means is controlled by a first set of parameters and another of said at least two loop means is controlled by a second set of parameters.

13. A musical tone synthesizing apparatus comprising:

excitation-signal generating means for generating an excitation signal from a noise signal and a musical-tone-waveform signal corresponding to a musical tone to be produced;

first and second loop means, each of which has a comb-like frequency characteristic and each of which delaying an input signal thereof by a delay time corresponding to a tone-pitch period of the musical tone to be produced while circulating the input signal therethrough, said excitation signal being supplied to at least one of said first and second loop means as its input signal;

filter means for performing filtering operations on said excitation signal and output signals of said first and second loop means respectively so as to output respective filtered signals;

mixing means for mixing said filtered signals outputted from said filter means so as to produce a musical tone signal representing a synthesized musical tone; and switching means for switching over a manner of connection between said first and second loop means so that said first and second loop means are connected in series or in parallel.

14. A musical tone synthesizing apparatus as defined in claim 13 further comprising:

overflow detecting means for detecting an overflow event in which a signal level of a signal circulating through each loop means exceeds a predetermined limit value; and level adjusting means for adjusting an input level of each loop means when said overflow detecting means detects the overflow event.

15. A musical tone synthesizing apparatus as defined in claim 13 further comprising:

indicator means for visually Indicating a signal level of a signal circulating through each loop means.

16. A musical tone synthesizing apparatus as defined in claim 15 wherein said indicator means is configured by a plurality of light-emitting diodes.

17. A musical tone synthesizing apparatus as defined in claim 13 wherein said noise signal represents a frictional sound which is caused due to a friction between a string and a bow of a string-bowing-type instrument.

* * * * *